US005968889A

United States Patent [19]

Wierenga

[11] Patent Number: 5,968,889

[45] Date of Patent: Oct. 19, 1999

[54] DETERGENT COMPOSITIONS COMPRISING A SYNERGISTIC ANTIFOAMING COMBINATION

[75] Inventor: Thomas J. Wierenga, Cincinnati, Ohio

[73] Assignee: The Procter & Gamble Company, Cincinnati, Ohio

[21] Appl. No.: 08/934,637

[22] Filed: Sep. 22, 1997

Related U.S. Application Data

[63] Continuation of application No. 08/674,045, Jul. 1, 1996, abandoned, which is a continuation of application No. 08/392,534, Mar. 1, 1995, abandoned, which is a continuation of application No. 08/220,137, Mar. 30, 1994, abandoned.

[51] Int. Cl.[6] ..... C11D 1/83

[52] U.S. Cl. ..... 510/423; 510/418; 510/488; 510/503

[58] Field of Search ..... 510/222, 223, 510/228, 229, 225, 232, 233, 333, 339, 356, 418, 422, 452, 423, 503, 488

[56] References Cited

U.S. PATENT DOCUMENTS

| | | | |
|---|---|---|---|
| 3,994,818 | 11/1976 | van der Loo et al. | 252/171 |
| 4,075,118 | 2/1978 | Gault et al. | 252/135 |
| 4,124,523 | 11/1978 | Johnson | 252/145 |
| 4,136,045 | 1/1979 | Gault et al. | 252/135 |
| 4,285,840 | 8/1981 | Fricker | 252/546 |
| 4,400,288 | 8/1983 | Dhanani et al. | 252/135 |
| 4,533,485 | 8/1985 | O'Connor et al. | 252/156 |
| 4,533,486 | 8/1985 | Scardera et al. | 252/156 |
| 4,585,563 | 4/1986 | Busch et al. | 252/8.8 |
| 4,587,630 | 5/1986 | Casey | 252/92 |
| 4,652,392 | 3/1987 | Baginski et al. | 252/109 |
| 4,686,060 | 8/1987 | Crabtree et al. | 252/90 |
| 4,798,679 | 1/1989 | Castro et al. | 252/174.15 |
| 5,238,596 | 8/1993 | Smith | 252/174.15 |
| 5,288,431 | 2/1994 | Huber et al. | 252/548 |
| 5,376,298 | 12/1994 | Michael | 252/153 |
| 5,700,768 | 12/1997 | Lu | 510/214 |

OTHER PUBLICATIONS

Olin Chemicals, Technical Bulletin, poly–tergent C– series sequestering polycarboxylated surfactants, CD–1541 (Apr. 26, 1991).

Olin Chemicals, Technical Bulletin, "Olin Surfactants Product Data", 721–052 (Jun. 1989).

Olin Chemicals, Technical Bulletin, "Olin Surfactants Product Data", 721–053R (Jun. 1991).

*Primary Examiner*—John R. Hardee

*Attorney, Agent, or Firm*—Karen F. Clark; Jacobus C. Rasser; Rose Ann Dabek

[57] ABSTRACT

Disclosed are detergent compositions comprising a suds inhibiting amount of a synergistic antifoaming combination, and preferably further comprising a high-sudsing surfactant such as an amine oxide surfactant. The antifoaming combination consists of a carboxylated poly(oxyalkylated) alcohol cosurfactant and a silicone antifoaming agent in a weight ratio of from about 1:50 to about 1000:1. Both individual elements of the antifoaming combination are known. The carboxylated poly(oxyalkylated) alcohol has the formula

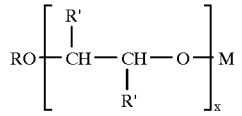

wherein R is a hydrocarbon-containing group having from about 6 to about 18 carbon atoms; each R' is independently selected from the group of hydrogen, methyl and carboxylic acid-containing groups having from 1 to 6 carbon atoms wherein the cosurfactant contains at least one such carboxylic acid-containing group; M is selected from the group of hydrogen and sulfate; x is a number from about 3 to about 75.

9 Claims, No Drawings

DETERGENT COMPOSITIONS COMPRISING A SYNERGISTIC ANTIFOAMING COMBINATION

This is a continuation of application Ser. No. 08/674,045, filed on Jul. 1, 1996 now abandoned which is a continuation of Ser. No. 08/392,534, filed Mar. 1, 1995, now abandoned, which is a Continuation-in-Part of Ser. No. 08/220,137 filed Mar. 30, 1994 in the name of Thomas J. Wierenga, now abandoned.

FIELD OF THE INVENTION

This invention relates to detergent compositions containing a synergistic antifoaming combination, especially detergent compositions further comprising a high-sudsing surfactant, e.g., amine oxide surfactant. The antifoaming combination consists of a silicone antifoaming agent and a carboxylated poly(oxyalkylated) alcohol cosurfactant.

BACKGROUND OF THE INVENTION

Detergent compositions normally contain surfactants which tend to produce suds (foam) when agitated in aqueous solution. For many applications, especially in automatic laundry and dishwashing machines, excess suds production is a serious problem with detergent compositions and with many detergent surfactants it is necessary to add suds inhibiting compounds, hereinafter referred to as antifoaming agents, in order to achieve acceptable sudsing characteristics.

Silicone-based materials, for example polydimethylsiloxane, are commonly used in detergent compositions as antifoaming agents. These silicone-based antifoaming agents, referred to generically hereinafter as silicone antifoaming agents, are known to be very useful at low levels in various detergent compositions. These silicone antifoaming agents have been incorporated singly or in combination with various solid materials such as silica aerogels and xerogels and hydrophobic silicas of various types, into solid and liquid detergent formulations.

There are, however, limitations to incorporating silicone antifoaming agents into certain detergent compositions. Silicone antifoaming agents are not as effective when used with suds boosting (high-sudsing) surfactants like fatty acid amides and alkanolamides, betaines, sulfobetaines and amine oxides, all of which tend to produce stable foams. Higher levels of silicone antifoaming agents are typically needed when used with such high-sudsing surfactants which can add substantially to formulation costs and with liquid formulations, in particular, can cause aesthetic problems. Silicone antifoaming agents by design are insoluble in water and are suspended as an emulsion with nonionic surfactants. At high levels, the silicone emulsion can be visible thus leading to a clouding or hazy appearance.

The foregoing considerations involving antifoaming agents for use in detergent compositions, especially high-sudsing detergent compositions, indicates that there is a continuing need to provide such compositions with improved antifoaming agents therein. Accordingly, it is an object of the present invention to provide a low-sudsing detergent composition with a highly effective antifoaming agent therein, and further to provide such a low-sudsing composition which also contains a high-sudsing surfactant. It is yet a further object of the present invention to provide such a composition wherein the high-sudsing surfactant is an amine oxide surfactant.

SUMMARY OF THE INVENTION

The present invention is directed to detergent compositions with low-sudsing characteristics, which compositions comprise a suds inhibiting amount of a synergistic antifoaming combination consisting of a silicone antifoaming agent and a carboxylated poly(oxyalkylated) surfactant. The synergistic surfactant has the general formula

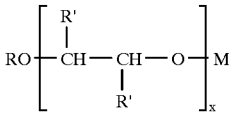

wherein R is a hydrocarbon-containing group having from about 6 to about 18 carbon atoms; each R' is independently selected from hydrogen, methyl and a carboxylic acid-containing group having from 1 to 6 carbon atoms wherein the synergistic surfactant contains at least one such carboxylic acid-containing group; M is hydrogen or a sulfate group; x is a number from about 3 to about 75; wherein the weight ratio of the carboxylated poly(oxyalkylated) alcohol surfactant to the silicone antifoaming agent is from about 1:50 to about 1000:1.

Some suitable carboxylated poly(oxyalkylated) alcohol cosurfactants for use in the instant composition, and the processes for making them, are disclosed in U.S. Pat. Nos. 4,533,485 and 4,533,486, which disclosures are incorporated herein by reference.

DETAILED DESCRIPTION OF THE INVENTION

The antifoaming combination of the detergent compositions of the present invention comprise two essential elements- a silicone antifoaming agent and a carboxylated poly(oxyalkylated) alcohol cosurfactant. These compositions preferably further comprise a high-sudsing surfactant. Such detergent compositions can be liquid, gel or granular formulations.

As used herein, "antifoaming" refers collectively to the inhibition of initial suds formation and to the accelerated defoaming of formed suds. The terms "suds" and "foam" are used interchangeably.

As used herein, the term "comprising" means various components conjointly employed in the composition of the present invention. Accordingly, the terms "consisting essentially of" and "consisting of" are embodied by the term "comprising."

As used herein, all parts, percentages and ratios are based on weight unless otherwise specified.

The detergent compositions of the present invention are described in detail as follows.

A. High-sudsing surfactant

The detergent compositions of the present invention preferably comprise a high-sudsing surfactant. The high-sudsing characteristics of such surfactants are effectively inhibited by a synergistic antifoaming combination (described hereinafter) which is incorporated into the detergent compositions.

It was found that detergent compositions comprising these high-sudsing surfactants benefit (antifoaming benefit) tremendously from the concomitant use of the synergistic antifoaming combination herein. Conversely, surfactants or detergent compositions with low to moderate sudsing characteristics show less benefit from the incorporation of this highly effective antifoaming combination.

High sudsing surfactants suitable for use in the detergent compositions herein are those surfactants that are typically used as suds boosters and stabilizers. Suitable high-sudsing surfactants include, but are not limited to, fatty acid amides, fatty acid alkanolamides, betaines, sulfobetaines, amine oxides, and mixtures thereof. These classes of high-sudsing surfactants are well known in the detergency art for use in intensive foaming applications, e.g. shampoo, hand dishwashing products. When incorporated into the instant composition, these surfactants can now be used at higher concentrations in low-foaming applications where the cleaning properties of such high-sudsing surfactants are desirable but their inherently intensive foaming properties are not.

Preferably, the high-sudsing surfactant is an amine oxide surfactant. These surfactants exhibit highly desirable cleaning characteristics that can now be incorporated into a low-sudsing detergent composition, e.g., laundry, machine dishwashing and hard surface cleaning products.

Amine oxide surfactant concentrations in the detergent compositions herein are not critical for purposes of the present invention. Such concentrations will vary depending upon, for example, the selected detergent formulation (e.g., granular, liquid, gel, concentrates thereof), its intended application (e.g., hard surface cleaning, laundry cleaning, automatic dishwashing), the degree of detergency desired and the sudsing profile of the selected surfactant component. Nevertheless, the detergent compositions herein preferably comprise from about 1% to about 60%, more preferably from about 2% to about 50%, and most preferably from about 3% to about 30%, by weight, of the amine oxide surfactant.

Known or conventional amine oxide surfactants can be used herein. These surfactants are prepared by the controlled oxidation of the corresponding tertiary amines. A common oxidizing agent for such purposes is hydrogen peroxide. Suitable methods for preparing amine oxide surfactants are described, for example, in U.S. Pat. No. 3,223,647 and British Patent 437,566.

A preferred amine oxide surfactant for use herein has the formula $R_1R_2R_3NO$, where $R_1$ is a substituted or unsubstituted alkyl or alkene group containing from about 8 to about 30, preferably about 8 to about 18, carbon atoms. Groups $R_2$ and $R_3$ are each substituted or unsubstituted alkyl or alkene groups containing from about 1 to about 18, preferably from about 1 to about 4, carbon atoms. More preferably, $R_2$ and $R_3$ are each methyl groups, examples of which include dodecyldimethyl amine oxide, tetradecyldimethyl amine oxide, hexadecyldimethyl amine oxide, octadecyldimethyl amine oxide, and coconut alkyldimethyl amine oxides.

Examples of preferred amine oxide surfactants for use herein include dodecyldimethyl amine oxide, tridecyldimethyl amine oxide, tetradecyl di-methyl amine oxide, pentadecyldimethyl amine oxide, hexadecyldimethyl amine oxide, heptadecyldimethyl amine oxide, octadecyldimethyl amine oxide, docecyldiethyl amine oxide, tetradecyldimethyl amine oxide, hexadecyldiethyl amine oxide, octadecyldiethyl amine oxide, dodecyldipropyl amine oxide, tetradecyldipropyl amine oxide, hexadecyl di-propyl amine oxide, octadecyldipropyl amine oxide, dodecyldibutyl amine oxide, tetra-decyldibutyl amine oxide, hexadecyldibutyl amine oxide, octadecyldibutyl amine oxide, dodecylmethylethyl amine oxide, tetradecylethylpropyl amine oxide, hexadecylpro-pylbutyl amine oxide, and octadecylmethylbutyl amine oxide.

Also preferred are amine oxide surfactants prepared by the oxidation of tertiary amines prepared from mixed alcohols obtainable from coconut oil. Such coconut alkyl amine oxide surfactants are preferred from an economic standpoint inasmuch as it is not necessary for the present purposes, to separate the mixed alcohol fractions into their pure components to secure the pure chain length fractions of the amine oxides.

B. Synergistic Antifoaming Combination

The detergent compositions of the present invention comprise a suds-inhibiting amount of an antifoaming combination, which combination comprises a silicone antifoaming agent and a carboxylated poly(oxyalkylated) alcohol surfactant. Both individual elements of the antifoaming combination are well known in the detergency art and are described hereinafter.

It was found that this antifoaming combination acts to dramatically inhibit foam formation and accelerate defoaming, especially in a high-sudsing detergent composition. Although these silicone antifoaming agents and carboxylated poly(oxyalkylated) alcohol cosurfactants each have antifoaming properties, it was found that the combination acts synergistically to inhibit foam formation and to accelerate defoaming in a detergent composition. The weight ratio of the synergistic cosurfactant to the silicone antifoaming agent in the detergent compositions is from about 1:50 to about 1000:1, preferably from about 1:10 to about 100:1, more preferably from about 1:1 to about 50:1.

The antifoaming combination of the instant composition is employed in a "suds inhibiting amount" which means that the formulator of the compositions can select an amount of the synergistic antifoaming combination to control sudsing to the extent desired. In automatic dishwashers, for example, a suds height of zero or near-zero is desirable such that relatively more of the synergistic antifoaming combination will be used. By contrast, less of the synergistic antifoaming combination is needed in manual dishwashing formulations. For laundry washing machines, the amount of suds which can be tolerated may vary widely depending on the particular application, and accordingly more or less of the antifoaming combination will be used. The amount of the synergistic antifoaming combination will also vary with the suds-generating profile of the selected surfactant for use in the composition. When, for example, an amine oxide surfactant is combined with an anionic surfactant, higher amounts of the suds-inhibiting combination may be needed since such surfactant combinations can have a very high and stable sudsing profile, e.g., more suds produced by the combination than by either surfactant alone.

Silicone antifoaming agents and carboxylated poly (oxyalkylated) alcohol surfactants suitable for use in the synergistic antifoaming combination are described in detail as follows.

1. Silicone Antifoaming Agent

Silicone materials employed as the silicone antifoaming agents herein can be alkylated polysiloxane materials of several types, either singly or in combination with various solid materials such as silica aerogels and xerogels and hydrophobic silicas of various types. In industrial practice the term "silicone" has become a generic term which encompasses a variety of relatively high molecular weight polymers containing siloxane units and hydrocarboxyl groups of various types. In general terms, the silicone antifoaming agents can be described as containing siloxane moieties having the general structure:

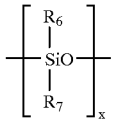

wherein x is a number from about 20 to about 2,000, and $R_6$ and $R_7$ are each alkyl or aryl groups, preferably alkyl groups containing from 1 to 4 carbon atoms. The polydimethylsiloxanes ($R_6$ and $R_7$ are methyl) having a molecular weight within the range of from about 200 to about 200,000, and higher, are all useful as antifoaming agents. Such silicone materials are commercially available from the Dow Corning Corporation under the trade name Silicone 200 Fluids.

Additionally, other silicone materials wherein the side chain groups $R_6$ and $R_7$ are alkyl, aryl, or mixed alkyl and aryl hydrocarbyl groups exhibit useful antifoaming properties. These materials are readily prepared by the hydrolysis of the appropriate alkyl, aryl or mixed alkylaryl silicone dichlorides with water in the manner well known in the art. As specific examples of such silicone antifoaming agents useful herein there can be mentioned, for example diethyl polysiloxanes, dipropyl polysiloxanes, dibutyl polysiloxanes, methylethyl polysiloxanes, phenylmethyl polysiloxanes, and the like. The dimethyl polysiloxanes are particularly useful herein due to their low cost and ready availability.

A second type of silicone antifoaming agent useful in the detergent compositions herein comprises a mixture of an alkylated siloxane of the type hereinabove disclosed and solid silica. Such mixtures of silicone and silica can be prepared by affixing the silicone to the surface of silica ($SiO_2$), for example by means of the catalytic reaction disclosed in U.S. Pat. No. 3,235,509. Antifoaming agents comprising mixtures of silicone and silica prepared in this manner preferably comprise silicone and silica in a silicone:silica ratio of from 19:1 to 1:2, preferably 10:1 to 1:1. The silica can be chemically and/or physically bound to the silicone in an amount which is preferably from about 10% to about 15% by weight, based on the silicone. The particle size of the silica employed in such silica/silicone antifoaming agents should preferably be not more than 100 millimicrons, and the specific surface area of the silica should exceed about 50 $m^2/g$.

Alternatively, antifoaming agents comprising silicone and silica can be prepared by admixing a silicone fluid of the type hereinabove described with a hydrophobic silica having a particle size and surface area in the range described above. Any of several known methods may be used for making a hydrophobic silica which can be employed herein in combination with a silicone as the silicone antifoaming agent herein. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is secured.

In an alternate procedure, a hydrophobic silica useful in the present compositions is obtained by contacting silica with any of the following compounds: metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred silicone antifoaming agent herein comprises a hydrophobic silanated (most preferably trimethylsilanated) silica having a particle size in the range from about 10 millimicrons to 20 millimicrons and a specific surface area above about 50 $m^2/g$ intimately admixed with a dimethyl silicone fluid having a molecular weight in the range from about 500 to about 200,000, at a weight ratio of silicone to silanated silica of from about 19:1 to about 1:2. Such silicone antifoaming agents preferably comprise silicone and the silanated silica in a weight ratio of silicone:silanated silica of from about 10:1 to 1:1. The mixed hydrophobic silanated (especially trimethylsilanated) silica-silicone antifoaming agents provide foam control over a broad range of temperatures, presumably due to the controlled release of the silicone from the surface of the silanated silica.

Yet another suitable silicone antifoaming agent comprises a silicone fluid, a silicone resin and silica. The silicone fluids useful in such mixtures are any of the types hereinabove disclosed, but are preferably dimethyl silicones. The silicone "resins" used in such compositions can be any alkylated silicone resins, but are usually those prepared from methysilanes. Silicone resins are commonly described as "three-dimensional" polymers arising from the hydrolysis of alkyl trichlorosilanes, whereas the silicone fluids are "two-dimensional" polymers prepared from the hydrolysis of dichlorosilanes. The silica components of such compositions are the microporous materials such as the fumed silica aerogels and xerogels having the particle sizes and surface areas hereinabove disclosed.

The mixed silicone fluid/silicone resins/silica materials useful in the present compositions can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

(a) from about 10 parts to about 100 parts by weight of a polydimethylsiloxane fluid having a viscosity in the range from 20 cs. to 1500 cs. at 25° C.;

(b) 5 to 50 parts by weight of a siloxane resin composed of $(CH_3)_3SiO^{+hd}$ ½ units and $SiO_2$ units in which the ratio of the $(CH_3)_3SiO^{+hd}$ ½ units to the $SiO_2$ units is within the range of from 0.6/1 to 1.2/1; and (c) 1 to 10 parts by weight of a silica aerogel.

Such mixtures can also be sorbed onto and into a water-soluble solid as disclosed above.

Dispersants are preferably used in the detergent composition in conjunction with the silicone antifoaming agents therein. Silicone antifoaming agents are generally not readily dispersible in aqueous surfactant systems. Such dispersants are well known in the art and include, for example, nonionic cosurfactants.

Self-emulsified silicone antifoaming agents can also be used thus obviating or minimizing the desirability of adding dispersants to the detergent composition. These antifoaming agents are highly dispersible in aqueous surfactant systems. Self-emulsified silicone antifoaming agents are characterized by an emulsifying component of the silicone structure. Preferred self-emulsified silicones are those which contain emulsifiers which have at least one polyoxyalkylene moiety incorporated into a basic polysiloxane structure. The polyoxyalkylene moieties are preferably incorporated as polymer groups substituted on silicone atoms and pendant on the basic polysiloxane chain. However, provided that the silicone compound is rendered into an emulsifier, the polyoxyalkylene moieties can be in other positions and may, for example, form a part of the basic polymer chain, e.g., as a block copolymer. The use of these preferred emulsifier moieties in the silicone structure permits the inclusion of the silicone antifoaming agent in an aqueous, alkaline crutcher mix, and the formation of a spray-dried, granular detergent composition containing the silicone antifoaming agent in active form.

Highly-preferred self-emulsified silicones of the type described above are typically represented by the formula $$R_aSiY_{4-a}$$

wherein a is 0 or an number from 1 to 3, R is selected from the group consisting of (a) alkyl groups containing from 1 to about 30 carbon atoms, (b) groups having the formula $$—R'—(OR)_bOR''$$

wherein R' is an alkylene group containing 1 to about 6, preferably from 2 to 4 carbon atoms, b has a value of from 1 to about 100; and R" is a capping group which can be selected from the group consisting of hydrogen, alkyl, aryl, alkylaryl, aralkyl or alkenyl groups containing up to 20 carbon atoms; acyl groups containing up to 20 carbon atoms, sulfate, sulfonate, phosphate, phosphonate, borate or isocyanate groups, or mixtures thereof; and Y is a group having the formula

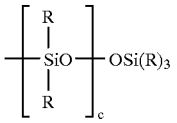

wherein R has the formula given hereinbefore, and c has a value from 1 to 200; and wherein at least one R group in the compound has the aforesaid formula $$(—R'(OR')_6—R'')$$

in which b is sufficiently large to create an emulsifier.

Preferred emulsifiers and self-emulsified silicone antifoaming agents containing them are described in Morehouse, U.S. Pat. Nos. 3,233,986 and 3,511,788, which descriptions are incorporated herein by reference. The agents described in U.S. Pat. No. 3,511,788 are most preferred. Preferred combinations of these emulsifiers together with silicone antifoaming agents are disclosed in British Patent 1,373,903 and U.S. Pat. No. 3,746,653, which patents are incorporated herein by reference. Preferably, the mixtures will contain at least 50% of $R_aSiY_{4-a}$, from about 5% to about 45% of a polydimethylsiloxane liquid and from 0.05% to about 5% of silica. The mixture can additionally comprise a minor amount of a polydimethylsiloxane resin.

Other effective self-emulsified silicone suds suppressors are those which contain a high ethoxylate of a fatty acid as the emulsifying component. The condensation products of from about 300 to about 2,000 moles of ethylene oxide for each mole of fatty acid are particularly useful. Fatty acids are straight-chain saturated and unsaturated monocarboxylic acids, usually containing an even number of carbon atoms (from about 10 to about 20), preferably around eighteen in number. Examples of common fatty acids include palmitic acid, stearic acid and oleic acid.

The emulsifying component may also be a zwitterionic surfactant. Zwitterionic surfactants useful herein include derivatives of aliphatic quaternary ammonium, phosphonium an sulfonium compounds in which the aliphatic moieties can be straight or branched chain, and wherein one of the aliphatic substituents contains an anionic water-solubilizing group. Preferred zwitterionic materials are the ethoxylated ammonium sulfonates and sulfates disclosed in U.S. Pat. No. 3,925,262 (Laughlin et al.), which patent is incorporated herein by reference.

The detergent compositions of the present invention will typically comprise from about 0.006% to about 1%, preferably from 0.01% to about 0.8%, more preferably from about 0.02% to about 0.6%, of the silicone antifoaming agent by weight of the detergent compositions. The amount of silicone antifoaming agent selected for use in the composition will depend upon the variables described hereinbefore and especially upon the formulation of the detergent compositions (e.g. liquid or nonliquid formulations).

2. Carboxylated poly(oxyalkylated) alcohol cosurfactant

The detergent compositions herein require a carboxylated poly(oxyalkylated) alcohol which acts synergistically with the silicone antifoaming agent to inhibit sudsing. These carboxylated poly(oxyalkylated) alcohols are compounds having- an aliphatic alcohol, ethylene oxide and or propylene oxide groups, and carboxyl containing groups.

The carboxylated poly(oxyalkylated) alcohol cosurfactants herein have the general formula

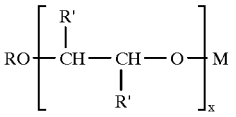

wherein R is a hydrocarbon-containing group having from about 6 to about 18 carbon atoms; each R' is independently selected from hydrogen, methyl and carboxylic acid-containing groups having from 1 to 6 carbon atoms wherein the cosurfactant structure contains at least one such carboxylic acid-containing group; M is hydrogen or a sulfate group; and x is a number from about 3 to about 75; wherein the weight ratio of the cosurfactant to the silicone antifoaming agent is from about 1:50 to about 1000:1. An example of such a cosurfactant suitable for use herein is "Olin CS-1", a carboxylated linear alkoxylated alcohol available from Olin Corporation.

Carboxylated poly(oxyalkylated) alcohol cosurfactants suitable for use in the instant composition are also disclosed in U.S. Pat. Nos. 4,533,485 and 4,533,486. These cosurfactants are prepared by forming a carboxylic acid group-containing addition product by reacting in the presence of a peroxy-type free radical initiator either maleic or fumaric acid, or a mixture thereof, with at least one poly (oxyalkylated) alcohol having the formula

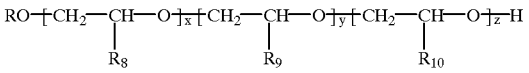

wherein R is a hydrocarbon-containing group having an average of from about 6 to about 18 carbon atoms; $R_8$, $R_9$ and $R_{10}$ are independently selected from hydrogen and methyl with the proviso that $R_9$ is different than $R_8$ and $R_{10}$; x is a number from 1 to about 25; y is a number from 1 to about 25; and z is a number from 0 to about 25. The weight ratio of poly(oxyalkylated) alcohol reactant to the dicarboxylic acid reactant is from about 95:5 to about 40:60. The dicarboxylic acid reactant replaces a hydrogen atom on a carbon adjacent to an oxygen atom in an ether linkage. A poly(oxyalkylated) $C_6$ alcohol, for example, with three oxypropylene groups and eight oxyethylene groups has twenty-three sites (carbon atoms adjacent to ether-oxygen) where the dicarboxylic acids could attach. Theoretically, individual carboxylic acid groups could attach to all twenty-three sites on this particular poly(oxyalkylated) alcohol, although steric effects will typically limit such attachment to less than the twenty-three theoretical sites.

Suitable poly(oxyalkylated) alcohols for use in preparing the cosurfactants herein include the following types:

$RO-(PO)_x-(EO)_y-H$ $RO-(EO)_x-(PO)_y-H$ $RO-(PO)_x-(EO)_y-(PO)_z-H$ $RO-(EO)_x-(PO)_y-(EO)_z-H$ wherein R, x, y, and z are as defined above and PO and EO stand for propylene oxide and ethylene oxide groups, respectively. Preferably, R is a linear, aliphatic hydrocarbon radical having an average of from about 8 to about 16 carbon atoms. It is believed that R can also be an alkyl-phenoyl group such as octylphenol, nonylphenol, and higher alkylphenols. Preferably, x is a number from about 2 to about 12. Preferably, y is a number from about 2 to about 15. Preferably, z is a number from about 5 to about 20.

The carboxylated poly(oxyalkylated) alcohols described herein can be treated with a sulfating agent to convert a majority of the terminal hydroxyl groups to sulfate groups, the terminal hydroxyl groups being the -OH groups farthest from the alcohol group (RO-). Any known or conventional sulfating agent can be used. The added sulfate groups can improve water solubility of the cosurfactant.

The carboxylated poly(oxyalkylated) alcohols, with or without added sulfate groups, may be neutralized in order to convert a majority of the total terminal carboxylic acid groups, or the terminal sulfate and carboxylic acid groups, on the cosurfactant structure. Preferred neutralizing agents include water soluble tertiary amines, alkali metal hydroxides and mixtures thereof, more preferably sodium hydroxide and potassium hydroxide. The amount of neutralization is preferably sufficient to convert at least about 95% of the carboxylic acid groups, or at least about 95% of the carboxylic acid and added sulfate groups, to the corresponding salt.

C. Other Ingredients

The detergent compositions of the present invention can further comprise additional ingredients to improve performance or aesthetics. Such additional ingredients should be compatible with the essential elements of the compositions described herein. Selection of such additional ingredients will depend largely upon the selected composition formulation, e.g., liquid or granular, and its intended application.

The detergent compositions herein can further comprise surfactants in addition to the carboxylated poly (oxyalkylated) alcohol cosurfactant described hereinbefore and the optional high-sudsing surfactants also described hereinbefore. Many such additional surfactants are known and can be classified as anionic, cationic, nonionic, zwitterionic or amphoteric. All such surfactant types can be used in the detergent compositions herein as optional additional surfactants provided that such optional additional surfactants are compatible with the essential elements of the instant composition. Some suitable additional surfactants are described, for example, in U.S. Pat. Nos. 3,664,961 and 4,798,579, which descriptions are incorporated herein by reference.

Other optional ingredients can include, but are not limited to, detergency builders, pH neutralizing agents , hydrotropes, enzymes, enzyme stabilizing agents, soil release polymers, dyes, brighteners, perfumes, antimicrobials, colorants, solvents, additional antifoaming agents and so forth.

The detergent compositions herein can be liquid or non-liquid (e.g., granular, gel) formulations. Liquid formulations of the present invention will typically comprise a water component and have a pH ranging from about 3 to about 13, preferably having a pH of 3 to 6 for acidic compositions, and about 7 for neutral compositions and from 8 to about 10 for basic compositions. Especially preferred are aqueous liquid formulations for use on hard surfaces. It is understood that the detergent compositions of the present invention can also be prepared in other formulations (e.g., granular, gel, concentrates) and for other applications.

D. Tests: Antifoaming Synergy

The following tests were performed to evaluate sudsing characteristics in the detergent compositions herein. More specifically, the following tests allowed us to measure the synergistic antifoaming properties of the antifoaming combination described herein.

Test Method: Any method for evaluating sudsing of a detergent composition can be used herein. The particular method actually used to evaluate sudsing of the instant composition is described hereinafter.

About 4 ounces of product are placed at the bottom of a dry 8 gallon bucket. About 4 gallons of cold tap water are added to the bucket over 33 seconds. The height between the cold water tap and the bottom of the bucket is 29 inches. When all of the tap water is added, the initial (time=0) suds height above the level of the water is measured. Additional measurements are taken at 30 second intervals for 5 minutes. Modifications to this test method (e.g., variations in tap flow rate, product dilution, tap height) can easily be made to fit individual circumstances.

Detergent formulations comprising coconut dimethyl amine oxide were prepared and evaluated for sudsing according to the above described test methods. Formulations and test results are described below in Tables 1 and 2. All numerical values are weight percents unless otherwise specified.

TABLE 1

| | Test Formulations | | | |
|---|---|---|---|---|
| Ingredients[a] | Formula A | Formula B | Formula C | Formula D |
| Coconut dimethyl amine oxide | 29 | 29 | 29 | 29 |
| Cosurfactant[b] | — | 2.0 | — | 2.0 |
| Silicone[c] | — | — | 0.06 | 0.06 |
| De-ionized water | qs to 100 | qs to 100 | qs to 100 | qs to 100 |

[a]each formulation contains <0.5 perfume, <0.5 dye

[b]Olin CS-1, a carboxylated linear alkoxylated alcohol, available from Olin Corp.

[c]Dow Corning AF-GPC, a polydimethyl siloxane, available from Dow Corning Corp.

TABLE 2

| | Test Results- Sudsing Profile | | | |
|---|---|---|---|---|
| Time (seconds) | Formula A Foam height (inches) | Formula B Foam height (inches) | Formula C Foam height (inches) | Formula D Foam height (inches) |
| 0 | 5.5 | 5.0 | 4.5 | 3.3 |
| 30 | 5.3 | 4.8 | 4.3 | 3.0 |
| 60 | 5.3 | 4.5 | 4.3 | 2.3 |
| 90 | 5.3 | 4.5 | 3.8 | 1.3 |
| 120 | 5.0 | 4.5 | 3.5 | 1.0 |
| 150 | 5.0 | 4.5 | 3.5 | 0.8 |
| 180 | 4.0 | 4.5 | 3.3 | 0.5 |
| 300 | 4.8 | 4.3 | 3.0 | 0.3 |

Superior suds inhibition was observed in Formula D (silicone+Olin CS-1) as compared to Formula A (control), Formula B (control+Olin CS-1) and Formula C (control+silicone). Control product was a high-sudsing amine oxide formulation without any antifoaming agents therein. The sudsing profile of Formula D clearly indicates a synergistic antifoaming effect provided by the combination of silicone+CS-1 incorporated therein.

* Superior suds inhibition as defined as a decrease in initial foam height and rapid breaking up of the remaining foam.

E. EXAMPLES

The following embodiments illustrate detergent compositions of the present invention, but are not intended to be limiting thereof.

EMBODIMENT 1

Acidic Liquid Hard Surface Cleaning Formulation

| Ingredient | Parts |
|---|---|
| De-ionized water seat | 50 |
| Dow Corning AF-GPC | 0.06 |
| Coconut dimethyl amine oxide | 29 |
| Olin CS-1 | 2.0 |
| Dye | 0-1 |
| Perfume | 0-1 |
| HCl (titrate to pH 4.5) | |
| De-ionized water | qs to 100 |

EMBODIMENT 2

The formulation of Embodiment 1 wherein the pH is titrated to 8.0 with 50% NaOH solution to form an alkaline hard surface cleaning formulation.

EMBODIMENT 3

Granular Laundry Detergent Formulation

| Ingredient | Parts |
|---|---|
| NaC13 linear alkyl benzene sulfonate | 11.5 |
| NaC14–15 fatty alcohol sulfate | 6.5 |
| Coconut dimethyl amine oxide | 6.0 |
| Olin CS-1 | 1.0 |
| Na2SO3 | 13.0 |
| Sodium silicate(1.6r) | 2.3 |
| Polyethylene glycol(M. Wt. 8,000) | 1.8 |
| Polyacrylic acid(M. Wt. 1,200) | 3.5 |
| Hydrated Zeolite A (ca. 2 microns) | 28.9 |
| Na2CO3 | 17.0 |
| Optical brightener | 0.2 |
| Protease enzyme | 0.6 |
| Dow Corning AF-GPC | 0.06 |
| Moisture and Miscellaneous | 7.64 |
| Total | 100.0 |

EMBODIMENT 4

Granular Floor Cleaning Formulation

| Ingredient | Parts |
|---|---|
| NaC13 linear alkyl benzene sulfonate | 19.0 |
| Coconut dimethyl amine oxide | 5.6 |
| Polyacrylic acid (M. Wt. 4,500) | 3.5 |
| Olin CS-1 | 1.0 |
| NaCitrate | 6.2 |
| Na2CO3 | 32.2 |
| Na2SO4 | 28.1 |
| PEG (M. Wt. 8,000) | 1.3 |
| Perfume | 0.1 |

-continued

| Ingredient | Parts |
|---|---|
| Dow Corning AF-GPC | 0.06 |
| Moisture and Miscellaneous | 2.9 |
| Total | 100.0 |

What is claimed is:

1. Detergent compositions containing a high sudsing amine oxide surfactant and an antifoaming combination, and having low-foaming and accelerated defoaming characteristics; said antifoaming combination consisting essentially of a foam inhibiting amount of the following:

(a) a carboxylated poly(oxyalkylated) alcohol cosurfactant having the formula

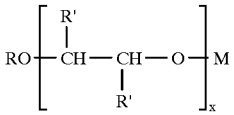

wherein R is a hydrocarbon-containing group having from about 6 to about 18 carbon atoms; each R' is independently selected from the group of hydrogen, methyl and carboxylic acid-containing groups having from 1 to 6 carbon atoms wherein said cosurfactant contains at least one such carboxylic acid-containing group; M is selected from the group of sulfate and hydrogen; and x is a number from about 3 to about 75; and (b) a silicone antifoaming agent, wherein the weight ratio of the cosurfactant to the silicone antifoaming agent is from about 40:1 to about 5:1, wberein said silicone antifoaming agent has siloxane moieties having The formula:

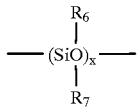

wherein x is a number from about 20 to about 2,000, and $R_6$ and $R_7$ are each independently alkyl groups each independently containing from 1 to about 4 carbon atoms.

2. A detergent composition according to claim 1 wherein said composition is a granular formulation.

3. A detergent composition according to claim 1 wherein said composition is an aqueous liquid.

4. A detergent composition according to claim 3 wherein said composition is titrated with an acid to a pH of from about 3 to about 6 and comprises from about 1% to about 50% by weight of an amine oxide surfactant.

5. A detergent composition according to claim 4 wherein said composition comprises from about 2% to about 30% by weight of an amine oxide surfactant.

6. A detergent composition comprising:

(a) a carboxylated poly(oxyalkylated) alcohol cosurfactant having the formula:

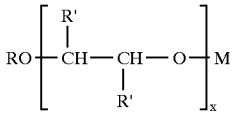

wherein R is a hydrocarbon-containing group having from about 6 to about 18 carbon atoms; each R' is independently selected from the group of hydrogen, methyl and carboxylic acid-containing groups having from 1 to 6 carbon atoms; M is selected from the group of sulfate and hydrogen; and x is a number from about 3 to about 75; and wherein said cosurfactant contains at least one carboxylic acid-containing group having from 1 to 6 carbon atoms;

(b) from about 0.006% to about 1%, by weight of the composition, silicone antifoam agent; and (c) from about 1% to about 60%, by weight of the composition, amine oxide surfactant;

wherein the weight ratio of carboxylated poly(oxyalkylated) alcohol to silicone antifoaming agent is from about40:1 to about 5:1.

7. A detergent composition according to claim 6 in the form of a liquid wherein the liquid has a pH of from about 8 to about 10.

8. A method of improving sudsing inhibition by a silicone antifoaming agent comprising the step of adding a carboxylated poly(oxyalkylated) alcohol to the silicone antifoaming agent in a weight ratio of from about 40:1 to about 5:1 carboxylated poly(oxyalkylated) alcohol to silicone antifoaming agent; wherein the carboxylated poly(oxyalkylated) alcohol has the formula:

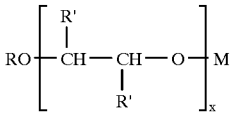

wherein R is a hydrocarbon-containing group having from about 6 to about 18 carbon atoms; each R' is independently selected from the group of hydrogen, methyl and carboxylic acid-containing groups having from 1 to 6 carbon atoms; M is selected from the group of sulfate and hydrogen; and x is a number from about 3 to about 75; and wherein said cosurfactant contains at least one carboxylic acid-containing group having from 1 to 6 carbon atoms.

9. A method according to claim 8 further comprising the step of adding a surfactant to form a detergent composition, wherein the silicone antifoaming agent is present at a level of from about 0.006% to about 1.0%, by weight of the detergent composition, and the carboxylated poly(oxylated) alcohol is present at a level of from about 1.0% to about 2.0%, by weight of the detergent composition.

* * * * *